US009010285B2

(12) United States Patent
Jaasma

(10) Patent No.: US 9,010,285 B2
(45) Date of Patent: Apr. 21, 2015

(54) ASSEMBLY FOR USE IN A CRANKCASE VENTILATION SYSTEM, A CRANKCASE VENTILATION SYSTEM COMPRISING SUCH AN ASSEMBLY, AND A METHOD FOR INSTALLING SUCH AN ASSEMBLY

(71) Applicant: Vialle Alternative Fuel Systems B.V., Eindhoven (NL)

(72) Inventor: Servatius Alfons Maria Jaasma, Eindhoven (NL)

(73) Assignee: Vialle Alternative Fuel Systems B.V., Eindhoven (NL)

( * ) Notice: Subject to any disclaimer, the term of this patent is extended or adjusted under 35 U.S.C. 154(b) by 0 days.

(21) Appl. No.: 14/050,422

(22) Filed: Oct. 10, 2013

(65) Prior Publication Data

US 2014/0034030 A1 Feb. 6, 2014

Related U.S. Application Data

(63) Continuation of application No. PCT/NL2012/050236, filed on Apr. 10, 2012.

(30) Foreign Application Priority Data

Apr. 11, 2011 (NL) ..... 2006586

(51) Int. Cl.
*F01M 13/00* (2006.01)
*F02M 25/06* (2006.01)
*F01M 13/02* (2006.01)

(52) U.S. Cl.
CPC ..... *F02M 25/06* (2013.01); *Y10T 29/49231* (2015.01); *F01M 13/022* (2013.01); *F01M 13/023* (2013.01); *F01M 13/025* (2013.01)

(58) Field of Classification Search
CPC ..... F01M 13/023; F01M 13/0011; F01M 13/025; F01M 13/00; F01M 2013/0038; F01M 2013/0083
USPC ..... 123/572, 573, 41.86
See application file for complete search history.

(56) References Cited

U.S. PATENT DOCUMENTS 3,589,347 A 6/1971 Sawada
4,901,703 A * 2/1990 Humphries ..... 123/572

(Continued)

FOREIGN PATENT DOCUMENTS

DE 102008018771 A1 10/2008
JP 61171814 A 8/1986
NL 6905648 A 1/1970

OTHER PUBLICATIONS

The International Search Report for PCT/NL2012/050236 issued on Jul. 20, 2012.

(Continued)

*Primary Examiner* — Stephen K Cronin
*Assistant Examiner* — Long T Tran
(74) *Attorney, Agent, or Firm* — Knobbe, Martens, Olson & Bear LLP

(57) ABSTRACT

An assembly for use in a crankcase ventilation system of an internal combustion engine includes a shutter arrangement that is constructed and arranged for preventing that residual gases and/or vapors out of a crankcase flow into an air intake system during a period of time that starts at shut down of the engine and ends after it has been re-started. The assembly also includes an outlet that is constructed and arranged for removing at least a substantial part of the residual gases and/or vapors from the engine as long as it is shut down.

17 Claims, 2 Drawing Sheets

(56) References Cited

U.S. PATENT DOCUMENTS

| | | | | |
|---|---|---|---|---|
| 5,329,913 | A * | 7/1994 | Suzuki et al. | 123/573 |
| 6,338,329 | B2 * | 1/2002 | Maegawa et al. | 123/339.15 |
| 6,457,462 | B2 * | 10/2002 | Moren | 123/572 |
| 7,316,226 | B2 * | 1/2008 | Callahan | 123/572 |
| 7,438,064 | B2 * | 10/2008 | Borchardt et al. | 123/572 |
| 7,891,346 | B2 * | 2/2011 | Asanuma et al. | 123/572 |
| 2003/0000504 | A1 * | 1/2003 | Katayama et al. | 123/516 |
| 2005/0011503 | A1 * | 1/2005 | Deane et al. | 123/572 |
| 2008/0092864 | A1 * | 4/2008 | Suzuki et al. | 123/574 |
| 2009/0241922 | A1 | 10/2009 | Okada | |
| 2012/0312272 | A1 * | 12/2012 | Kobayashi et al. | 123/196 R |

OTHER PUBLICATIONS

The International Preliminary Report on Patentability for PCT/NL2012/050236 issued on Oct. 15, 2013.

* cited by examiner 21
20
31
32
31
1
26
29
25
30
28
4
43
28
28
22
42
14
40
41
15
17
32
12
16
32
13
5
2
19
18
8
6
27
7
8
7
24
10
23
32
9
3
28
11

ASSEMBLY FOR USE IN A CRANKCASE VENTILATION SYSTEM, A CRANKCASE VENTILATION SYSTEM COMPRISING SUCH AN ASSEMBLY, AND A METHOD FOR INSTALLING SUCH AN ASSEMBLY

CROSS REFERENCE TO RELATED APPLICATIONS

This application is a continuation of PCT application number PCT/NL2012/050236 filed on 10 Apr. 2012, which claims priority from Netherlands application number 2006586 filed on 11 Apr. 2011. Both applications are hereby incorporated by reference in their entireties.

BACKGROUND OF THE INVENTION

1. Field of the Invention

The present invention relates to an assembly for use in a crankcase ventilation system of an internal combustion engine with at least one cylinder having a piston and a combustion chamber. The present invention also relates to a crankcase ventilation system for use in an internal combustion engine, wherein the crankcase ventilation system comprises such an assembly. The present invention further relates to an internal combustion engine comprising a crankcase ventilation system as mentioned above. The present invention also relates to a vehicle comprising an internal combustion engine as mentioned above. The present invention further relates to a method for providing an assembly according to the present invention in a crankcase ventilation system of an internal combustion engine.

2. Description of the Related Art

Crankcase ventilation systems are commonly known and are used in internal combustion engines, such as diesel, gasoline and liquefied gas powered direct injection engines, for removing blow-by gases, i.e. gases that leak past piston rings, and other vapors from the engine's crankcase. To accomplish this, a crankcase ventilation system is constructed and arranged for allowing fresh air that is drawn from an air cleaner unit of an air intake system to enter the engine's crankcase via a first duct, which is generally indicated as breather duct. Furthermore, the crankcase ventilation system comprises elements constructed and arranged for purging unwanted gases and/or vapors from the crankcase. This is usually accomplished by providing a second duct, which is generally indicated as purge duct. The purge duct is arranged between a valve cover and an air intake duct. The purge duct comprises a control valve that is constructed and arranged for controlling the amount of gases and/or vapors out of a crankcase that enter the air intake duct as a function of engine load and/or throttle valve opening. The purge duct is usually connected to the air intake duct at a position where air pressure in the air intake duct is lower than the pressure in the crankcase when the engine is running. This location is usually in the vicinity of the throttle valve. Instead of venting the gases and/or vapors to the outside environment they are fed back into the air intake duct and re-enter a combustion chamber as part of a fresh charge of air and/or fuel.

An amount of air from the air cleaner unit is fed into the engine's crankcase via the breather duct. Once inside the crankcase, the air circulates around its interior thereby picking up and removing among others gases and byproducts of the combustion process and vapors, e.g. water vapor, which might include dissolved chemical combustion products and/or byproducts. These gases and/or vapors pass an oil separator element, e.g. a baffle or a mesh, in order to trap oil droplets before being drawn out of the valve cover through the control valve of the crankcase ventilation system, into the air intake duct.

As mentioned above, the crankcase ventilation system relies on the fact that, while the engine is running under light load and moderate throttle opening, the pressure in the air intake duct is lower than the air pressure in the crankcase. As a result of this lower pressure, air is drawn into the air intake duct, thereby pulling air consecutively from the breather duct through the crankcase, where it dilutes and mixes with the abovementioned gases and/or vapors, through the control valve of the crankcase ventilation system, and into the air intake duct. If the air pressure in the air intake duct is higher than that in the crankcase, the abovementioned control valve reduces its flow opening to at least strongly reduce reversal of the exhausted air back into the crankcase.

A drawback of conventional crankcase ventilation systems is that after the engine has been shut down residual gases and/or vapors out of the crankcase can accumulate in the air intake system as the control valve of the crankcase ventilation system is constructed and arranged such that it never completely closes the purge duct. As a result, the residual gases and/or vapors out of the crankcase at least partly replace the air present in the air intake duct of the air intake system. When the engine has been shut down for a long period of time, typically 12 hours or more, the engine frequently fails to start at a first attempt. This is caused by an over-rich mixture comprising air, residual gases and/or vapors out of the crankcase and/or fuel, which is drawn into the combustion chambers during cranking.

BRIEF SUMMARY OF THE INVENTION

It is a first object of the present invention to provide an improved assembly for use in a crankcase ventilation system of an internal combustion engine. In an embodiment the assembly improves starting of such an engine in such a way that it starts substantially at the first attempt, particularly after it has been shut down for a long period of time as mentioned above. It is a second object of the present invention to provide a crankcase ventilation system that comprises such an assembly. It is a third object of the present invention to provide an internal combustion engine comprising a crankcase ventilation system as mentioned above. It is a fourth object of the present invention to provide a vehicle comprising an internal combustion engine as mentioned above. It is a fifth object of the present invention to provide a method for providing an assembly according to the invention in a crankcase ventilation system of an internal combustion engine.

At least one of these objects is achieved by an assembly comprising a shutter arrangement that is constructed and arranged for preventing that residual gases and/or vapors out of a crankcase flow into an air intake system for the cylinder during a period of time that starts at shut down of the engine and ends after it has been re-started, and an outlet that is constructed and arranged for removing at least a substantial part of the residual gases and/or vapors from the engine as long as it is shut down. Contrary to the control valve of the crankcase ventilation system, the shutter arrangement of the assembly according to the present invention is constructed and arranged to move towards a closed position when the engine is shut down and remains closed until after the engine has been re-started. In this way, the shutter arrangement prevents that residual gases and/or vapors out of a crankcase flow into the air intake duct of the air intake system as long as the engine is shut down and upon re-starting of the engine because of the considerable under pressure that is generated in the purge duct upon cranking. At least a substantial part of the residual gases and/or vapors out of a crankcase can escape from the engine, e.g. towards the outside environment, via the outlet of the assembly according to the present invention. The residual gases and/or vapors that still might be present in a crankcase even after the engine has been shut down for a long time, e.g. 12 hours or more, will not be drawn into the air intake duct upon re-starting of the engine. In this way, it is prevented that the mixture that is drawn into the combustion chambers during cranking is over-rich due to residual gases and/or vapors out of a crankcase. As a result, the engine should start at the first attempt even when the engine has been shut down for a long period of time, e.g. 12 hours or more.

In an embodiment of the assembly according to the present invention, the internal combustion engine is a liquefied gas powered direct injection engine. Especially in the case of engines that are powered by a liquefied gas, e.g. propane, butane or a mixture thereof, it is important to prevent the supply of an over-rich mixture to the combustion chambers at the first attempt of starting the engine when it has been shut down for a long period of time as mentioned above.

In an embodiment of the assembly according to the present invention, the shutter arrangement comprises a first shutter element that is positioned in a purge duct of the crankcase ventilation system, wherein the first shutter element is constructed and arranged for preventing that residual gases and/or vapors out of a crankcase flow into an air intake system as long as the engine is shut down. The first shutter element is constructed and arranged such that it will not hamper the operation of the crankcase ventilation system when the engine is running, i.e. gases and/or vapors out of a crankcase can flow passed the first shutter element into the purge duct and ultimately into the air intake duct. However, as long as the engine is shut down, the first shutter element closes and thereby prevents that residual gases and/or vapors out of a crankcase flow into the purge duct. As a result, these gases and/or vapors cannot accumulate in at least part of the air intake system as long as the engine is down. The mixture that is drawn into the combustion chamber upon cranking at least comprises less residual gases and/or vapors out of a crankcase, thereby improving re-starting of the engine at the first attempt.

In an embodiment of the assembly according to the present invention, the first shutter element is positioned in a first part of the purge duct, wherein the first part is arranged between a valve cover provided over an upper part of the cylinder, and a control valve of the crankcase ventilation system. As the first shutter element is positioned upstream of the control valve of the crankcase ventilation system, the residual gases and/or vapors out of the crankcase can at most accumulate in a part of the purge duct that is located upstream of the first shutter element of the assembly according to the present invention.

In an embodiment of the assembly according to the present invention, the first shutter element is a one-way valve that is constructed and arranged for preventing that residual gases and/or vapors out of a crankcase flow into the air intake system as long as the engine is shut down. A one-way valve provides a cost effective implementation of the first shutter element as no active components are required. It is obvious for a person skilled in the art that many different embodiments of such a one-way valve can be envisaged.

In an embodiment of the assembly according to the present invention, the one-way valve is constructed and arranged such that it has an opening pressure of typically at least about 1 mbar (10 mm $H_2O$). When the engine has been shut down, such an opening pressure should be sufficient to keep the one-way valve closed for residual gases and/or vapors that diffuse out of the crankcase. As a result, these gases and/or vapors are blocked out of at least part of the purge duct and therefore cannot accumulate in the air intake duct.

In an embodiment of the assembly according to the present invention, the outlet is constructed and arranged in the first part of the purge duct upstream of the first shutter element such that at least a substantial part of the residual gases and/or vapors out of a crankcase are removable from the engine as long as it is shut down. The outlet, which for example is a tube like element and/or an opening, has a diameter that typically lies in a range of 1-8 mm, preferably is about 3 mm. Such diameters on the one hand enable effective removal of at least a substantial part of the residual gases and/or vapors out of a crankcase from the engine as long as it is shut down and on the other hand do not or at least do not significantly disturb the operation of the crankcase ventilation system when the engine is running. The outlet can be configured such that it has a constant diameter, however, the outlet can also be constructed and arranged such that the diameter is adjustable. The latter provides tuning capabilities for optimizing the performance of the assembly according to the present invention depending for example on the type of engine. As a result, the tuning capabilities enable further optimization of starting of the internal combustion engine after it has been shut down for a long period of time, e.g. 12 hours or more, such that it starts substantially at the first attempt.

In an embodiment of the assembly according to the present invention, the outlet is connectable to a storage element that is constructed and arranged for storing the residual gases and/or vapors. Such a storage element could for example be a well known carbon canister. In this way the residual gases and/or vapors out of the crankcase are not exhausted to the outside environment but are stored in the trapping element. In this way contamination of the outside environment can be prevented. When the engine is started the trapping element is emptied as the trapped gases and/or vapors are drawn into the combustion chambers via the outlet of the assembly, the purge duct and the air intake duct consecutively.

In an embodiment of the assembly according to the present invention, the shutter arrangement comprises a second shutter element that is positioned in the purge duct downstream of the first shutter element, wherein the second shutter element is constructed and arranged for preventing that residual gases and/or vapors out of a crankcase flow into the air intake system during the period of time that starts at shut down of the engine and ends after it has been re-started. In this way, the second shutter element prevents that residual gases and/or vapors that still might be present in a crankcase even after the engine has been shut down for a long time, e.g. 12 hours or more, will not be drawn into the air intake duct via the purge duct of the crankcase ventilation system upon re-starting of the engine. Hence, it is prevented that the mixture that is drawn into the combustion chambers during cranking is over-rich due to residual gases and/or vapors out of a crankcase. As a result, restarting of the engine at the first attempt even when the engine has been shut down for a long period of time, e.g. 12 hours or more, is further improved.

In an embodiment of the assembly according to the present invention, the second shutter element is positioned in a second part of the purge duct, wherein the second part is arranged between the control valve and an air intake duct of the air intake system. The second shutter element preferably is arranged in a part of the second part of the purge duct that has a smaller diameter, e.g. a diameter that lies in a range of 1-2 mm, than the rest of the purge duct, the diameter of which usually lies in a range of 12-18 mm, typically 16 mm.

In an embodiment of the assembly according to the present invention, the second shutter element is constructed an arranged such that it is switchable between at least a first and a second state, wherein the second shutter element is in the first state during the period of time that starts at shut down of the engine and ends after it has been re-started, and wherein the second shutter element is in the second state outside that period of time. By positioning the second shutter element in a part of the second part of the purge duct that has a reduced diameter as mentioned above, it is possible to switch the second shutter element between its first and second state irrespective of the presence of a significant under pressure in the air intake duct upon re-starting of the engine.

In an embodiment of the assembly according to the present invention, the second shutter element is constructed and arranged for disconnecting the purge duct from the air intake duct and allowing air out of an air cleaner unit to flow into the air intake duct via at least a part of the second part of the purge duct when it is in the first state. In this state the second shutter element prevents that residual gases and/or vapors out of a crankcase are drawn into the air intake duct. In addition, by allowing air from the air cleaner unit to flow into the air intake duct via at least a part of the second part of the purge duct, it is prevented that starting problems occur due to an erroneous calculation of the amount of air required during cranking.

In an embodiment of the assembly according to the present invention, the second shutter element is constructed and arranged for allowing gases and/or vapors out of a crankcase to flow into the air intake duct via at least a part of the second part of the purge duct when it is in the second state. In this state, the engine is running and normal operation of the crankcase ventilation system is not hampered in any way, i.e. the gases and/or vapors out of a crankcase re-enter a combustion chamber as part of a fresh charge of air and/or fuel.

In an embodiment of the assembly according to the present invention, the second shutter element is a computer controlled 3/2 valve. Such a 3/2 valve has a three ports and is switchable between two states. A first port is connected to the second part of the purge duct, a second port is connected to the air cleaner unit via a duct, and a third port is connected to the air intake duct. In a first state of the 3/2 valve according to the present invention a channel is present between the first and the third ports. In a second state of the 3/2 valve according to the present invention a channel is present between the second and the third ports. Software is used to switch between these two states and to control the timing of the switching process. In addition, it is possible to easily adjust the amount of time that must elapse after re-starting of the engine before the second shutter element, i.e. the 3/2 valve, might be switched from the first to the second state. In this way re-starting of the engine can be further optimized.

According to another aspect of the present invention a crankcase ventilation system for use in an internal combustion engine is provided, wherein the crankcase ventilation system comprises an assembly according to the invention. Such crankcase ventilation system enables improving starting of the internal combustion engine after it has been shut down for a long period of time, e.g. 12 hours or more, such that it starts substantially at the first attempt.

According to another aspect of the present invention an internal combustion engine is provided comprising a crankcase ventilation system having an assembly according to the invention. Such engine has improved starting capabilities after it has been shut down for a long period of time, e.g. 12 hours or more, such that it starts substantially at the first attempt.

According to another aspect of the present invention a vehicle is provided comprising an internal combustion engine having a crankcase ventilation system that comprises an assembly according to the invention. Such vehicle has improved performance as its engine is capable substantially at the first attempt after it has been shut down for a long period of time, e.g. 12 hours or more.

According to another aspect of the present invention a method is provided for providing an assembly in a crankcase ventilation system of an internal combustion engine with at least one cylinder having a piston and a combustion chamber, wherein the method comprises:

- arranging a first shutter element in a purge duct of the crankcase ventilation system, wherein the first shutter element is positioned between a valve cover provided over an upper part of the cylinder, and a control valve of the crankcase ventilation system; and/or
- arranging a second shutter element in the purge duct, wherein the second shutter element is positioned between the control valve and an air intake duct for the cylinder; and
- arranging an outlet in the purge duct, wherein the outlet is constructed and arranged for removing at least a substantial part of residual gases and/or vapors out of a crankcase from the engine as long as it is shut down.

BRIEF DESCRIPTION OF THE DRAWINGS

The invention will be explained in more detail below with reference to drawings in which an illustrative embodiment of the invention is shown. The person skilled in the art will realize that other alternatives and equivalent embodiments of the invention can be conceived and reduced to practice without departing from the scope of the present invention.

DESCRIPTION OF ILLUSTRATIVE EMBODIMENTS

Figure 1:
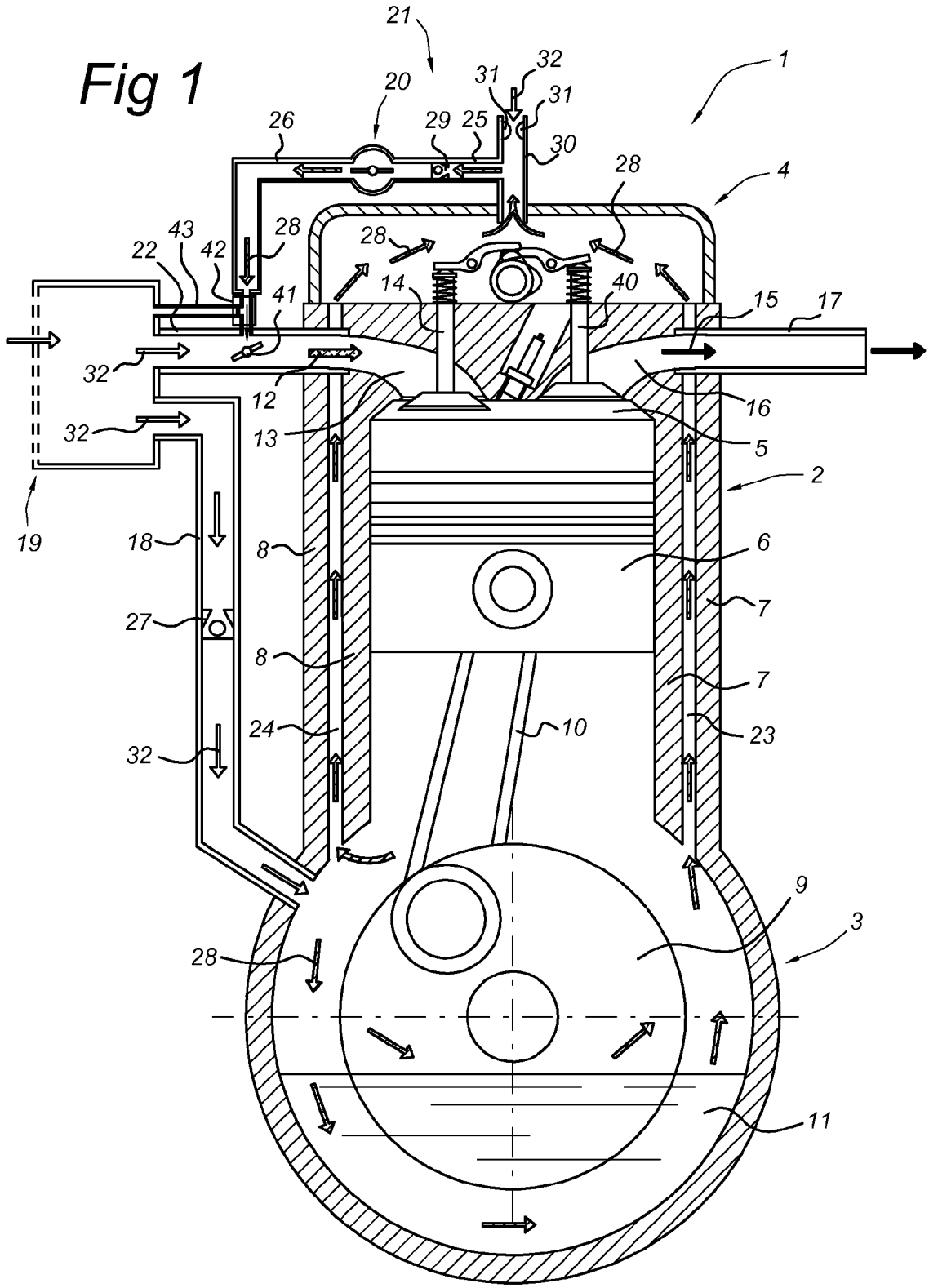
FIG. 1 shows a schematic cross section of a part of an internal combustion engine comprising an assembly according to the present invention.

The figures are not necessarily drawn to scale. Identical components in the figures are denoted by the same reference numerals.

FIG. 1 shows a schematic cross section of part of an internal combustion engine 1 comprising a cylinder 2 that is connected at its lower end to a crankcase 3 and at its upper end to a valve cover 4. Various flows of gases and/or vapors are schematically indicated in the case that the engine is running. The cylinder 2 comprises a combustion chamber 5 having a piston 6 that is constructed and arranged for being movable inside the combustion chamber 5 while being in sliding contact with the walls 7, 8 of the cylinder 2. The piston 6 is connected to a crankshaft 9 via a connecting element 10. The crankshaft 9 is supplied with a lubricant 11, e.g. oil, for smooth operation and/or cooling and to prevent wear.

A mixture 12 comprising air 32 and/or fuel can enter the combustion chamber 5 via an intake manifold 13 that can be closed by an inlet valve 14. After combustion of the mixture 12, an outlet valve 40 is opened and exhaust gases 15 are removed from the combustion chamber 5 via an outlet manifold 16 that is connected to an exhaust duct 17. Valve cover 4 is provided over an upper part of the cylinder 2, which upper part in the embodiment shown comprises inlet valve 14 and outlet valve 40.

During a normal compression stroke, a small amount of the combustion gases and/or vapors can end up in the crankcase 3 due to leakage of these gases and/or vapors past piston rings. Consequently, such gases and/or vapors are generally indicated as blow-by gases and/or vapors. These blow-by gases and/or vapors can dilute and contaminate the oil 11 in the crankcase 3, cause corrosion to critical parts and contribute to sludge build up. At higher engine speeds, blow-by gases and/or vapors increase crankcase pressure. This can cause the oil 11 to leak from sealed engine surfaces. By using a crank case ventilation system the blow-by gases and/or vapors can be removed from the crankcase 3 before damage occurs and they can be combined with the engine's normal incoming mixture comprising air and/or fuel. A crankcase ventilation system comprises a breather duct 18, which is connected between an air cleaner unit 19 of an air intake system and the crankcase 3, and a control valve 20 that is arranged in a purge duct 21, which is connected between the valve cover 4 and an air intake duct 22 at a position where air pressure in the air intake duct 22 is lower than the pressure in the crankcase 3 when the engine 1 is running. This location is usually in the vicinity of the throttle valve 41. FIG. 1 shows that the breather duct 18 comprises a one-way valve 27 to prevent gases and/or vapors out of the crankcase 3 to end up in the air cleaner unit 19.

In order to remove the blow-by gases and/or vapors from the crankcase 3 air 32 from the air cleaner unit 19 is drawn into the crankcase 3 via the breather duct 18 thereby passing one-way valve 27. Once inside the crankcase 3, the air 32 circulates around its interior thereby picking up the blow-by gases and/or vapors. A mixture 28 of air 32 and blow-by gases and/or vapors is consecutively drawn through ducts 23, 24, which are provided in the walls 7, 8 respectively of the cylinder 2, the valve cover 4, a first part 25 of the purge duct 21, the control valve 20, a second part 26 of the purge duct 21 before entering the air intake duct 22 at a position where air pressure in the air intake duct 22 is lower than the pressure in the crankcase 3 when the engine 1 is running. In this way the blow-by gases and/or vapors are removed from the crankcase 3 and are fed back into the air intake duct 22 and enter the combustion chamber 5 as part of a fresh charge of air 32 and/or fuel.

As mentioned above, a drawback of conventional crankcase ventilation systems is that after the engine 1 has been shut down residual gases and/or vapors 33 out of the crankcase 3 can accumulate in the air intake system as the control valve 20 of the crankcase ventilation system is constructed and arranged such that it never completely closes the purge duct 21. As a result, the residual gases and/or vapors 33 out of the crankcase 3 at least partly replace the air 32 present in the air intake duct 22 of the air intake system. When the engine 1 has been shut down for a long period of time, typically 12 hours or more, the engine 1 frequently fails to start at a first attempt. This is caused by an over-rich mixture comprising air 32, residual gases and/or vapors 33 out of the crankcase 3 and/or fuel, which is drawn into the combustion chamber 5 during cranking.

According to the present invention an assembly is provided comprising a shutter arrangement having a first shutter element 29 and a second shutter element 42, which prevent that the residual gases and/or vapors 33 out of the crankcase 3 can flow into the air intake system during a period of time that starts at shut down of the engine (1) and ends after it has been re-started, and an outlet 30 through which the residual gases and/or vapors 33 can escape from the engine 1 a long as it is shut down.

Figure 2:
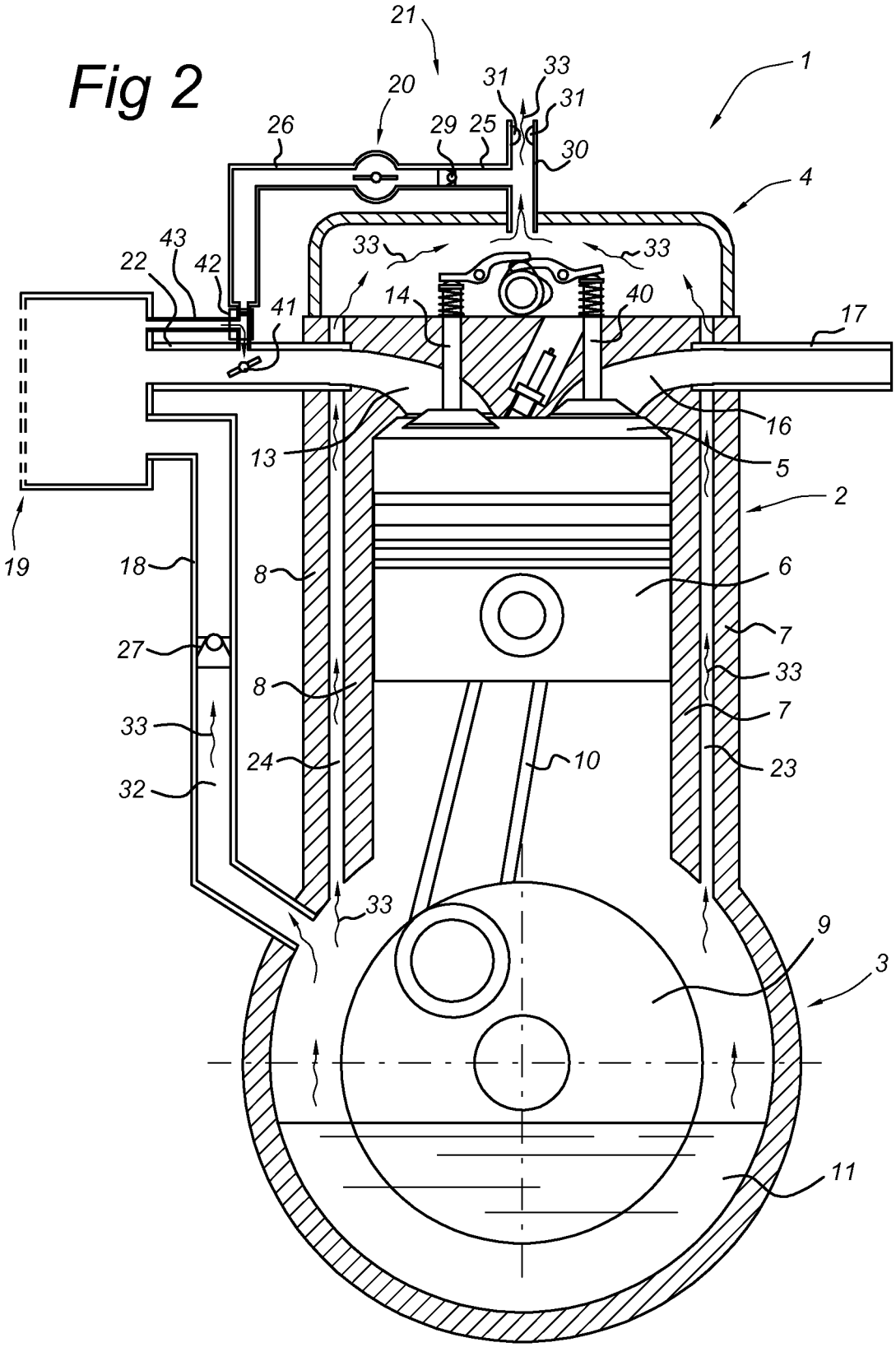
FIG. 2 shows a schematic cross section of a part of the internal combustion engine comprising an assembly according to the present invention as shown in FIG. 1.

In the embodiment of the assembly according to the present invention as shown in FIG. 1 the first shutter element 29 is a one-way valve 29 that is arranged in the first part 25 of the purge duct 21 that is connected between the valve cover 4 and the control valve 20 of the crankcase ventilation system. It will be clear to the person skilled in the art that many configurations of the one-way valve 29 can be envisaged. The illustrative embodiment of the one-way valve 29 as shown in FIG. 1 comprises a ball valve. Alternative embodiments might for example comprise pistons, plungers and/or a combination of a flap and a seat. The one-way valve 29 is constructed and arranged such that it has an opening pressure of typically at least about 1 mbar (10 mm $H_2O$). As long as the engine 1 is shut down, as is shown in FIG. 2, such an opening pressure should be sufficient to keep the one-way valve 29 closed for residual gases and/or vapors 33 that diffuse out of the crankcase 3. As a result, these gases and/or vapors 33 are blocked out of at least part of the first part 25 of the purge duct 21 and therefore cannot accumulate in the air intake duct 22.

FIG. 1 shows that the one-way valve 29 will not hamper the operation of the crankcase ventilation system when the engine 1 is running. However, when the engine 1 is shut down, it closes and thereby prevents that residual gases and/or vapors 33 out of the crankcase 3 flow into at least part of the first part 25 of the purge duct 21.

FIG. 1 shows that the outlet 30 of the assembly according to the present invention is arranged upstream of the one-way valve 29 in the first part 25 of the purge duct 21. The illustrative embodiment of the outlet 30 as shown in FIG. 1 comprises a tube having restriction elements 31 that are used to adjust the diameter of the outlet 30, which typically lies in a range of 1-8 mm, preferably is about 3 mm. Such diameters on the one hand enable effective removal of the residual gases and/or vapors 33 out of the crankcase 3 from the engine 1 when it has been shut down as is shown in FIG. 2 and on the other hand do not or at least not significantly disturb the operation of the crankcase ventilation system when the engine 1 is running. The outlet 30 can also be configured such that it has a constant diameter. However, an adjustable diameter of the outlet 30 provides tuning capabilities for optimizing the performance of the assembly according to the present invention depending for example on the type of engine 1. As a result, the tuning capabilities enable further optimization of starting of the internal combustion engine 1 after it has been shut down for a long period of time, e.g. 12 hours or more, such that it starts substantially at the first attempt.

It will be clear to the person skilled in the art that many configurations of the outlet 30 can be envisaged. An alternative embodiment of the outlet 30 might for example be a hole with a constant diameter or constructed and arranged such that its diameter is adjustable. FIG. 1 shows that air 32 is drawn into the purge duct 21 via the outlet 30 when the engine 1 is running and the blow-by gases and/or vapors 33 are being removed from the crankcase 3. This will neither hamper the operation of the crankcase ventilation system nor the operation of the engine 1.

In the embodiment of the assembly according to the present invention as shown in FIG. 1 the second shutter element 42 is a computer controlled 3/2 valve that has three ports and is switchable between two states. A first port of the 3/2 valve 42 is connected to the second part 26 of the purge duct 21, a second port is connected to the air cleaner unit 19 via a duct 43, and a third port is connected to the air intake duct 22. In a second state of the 3/2 valve 42, as is shown in FIG. 1, a channel is present between the first and the third ports through which the gases and/or vapors out of the crankcase 3 can flow into the air intake duct 22.

FIG. 2 shows a schematic cross section of a part of the internal combustion engine 1 comprising an assembly according to the present invention as shown in FIG. 1, wherein a flow of residual gases and/or vapors out of the crankcase is schematically indicated in the case that the engine has been shut down. Internal combustion engine 1 has an assembly according to the present invention that comprises a shutter arrangement having a one-way valve 29, a 3/2 valve 42, and an outlet 30, wherein a flow of residual gases and/or vapors 33 out of the crankcase 3 is schematically indicated in the case that the engine 1 has been shut down. In this case, the one-way valve 27 in the breather duct 18 and the one-way valve 29 in the purge duct 21 are both in a closed position thereby preventing that the residual gases and/or vapors 33 out of the crankcase 3 flow into the air cleaner unit 19 and air intake duct 22 respectively. Instead, these gases and/or vapors 33 flow from the crankcase 3 into the outer environment and/or a storage element such as a carbon canister (not shown) after consecutively passing through the ducts 23, 24 in the walls 7, 8 respectively, the valve cover 4 and the outlet 30.

FIG. 2 shows that in the first state of the 3/2 valve 42 a channel is present between the second port that is connected to the air cleaner unit 19 via the duct 43, and the third port that is connected to the air intake duct 42. This allows air out of the air cleaner unit 19 to flow into the air intake duct 22 via the duct 43 and at least a part of the second part 26 of the purge duct 21. In this way, it is prevented that starting problems occur due to an erroneous calculation of the amount of air required during cranking.

As a result, an engine 1 having an assembly comprising a shutter arrangement having a first shutter element 29 and a second shutter element 42, and an outlet 30 according to the present invention should be able to start at the first attempt after the engine 1 has been shut down for a long period of time, e.g. 12 hours or more, because the mixture 12 comprising air 32 and/or fuel, which is drawn into the combustion chamber 5 upon cranking, is not over-rich due to residual gases and/or vapors 33 out of the crankcase 3.

Variations on the embodiment of the assembly as shown in FIGS. 1 and 2 are imaginable, without diverting from the main notion of the invention. It will be clear that the invention is described by using a preferred embodiment. The invention is not intended to be limited to this embodiment. The scope of protection sought is determined by the following claims within the scope of which many modifications can be envisaged.

What is claimed is:

1. An assembly for use in a crankcase ventilation system of an internal combustion engine with at least one cylinder having a piston and a combustion chamber, the assembly comprising:

a shutter arrangement that is constructed and arranged for preventing residual gases and/or vapors out of a crankcase flow into an air intake system for the cylinder during a period of time that starts at shut down of the engine and ends after it has been re-started, and an outlet that is constructed and arranged for removing at least a part of the residual gases and/or vapors from the engine as long as it is shut down, wherein the shutter arrangement comprises a first shutter element that is positioned in a purge duct of the crankcase ventilation system, wherein the first shutter element is constructed and arranged for preventing residual gases and/or vapors out of a crankcase flow into an air intake system as long as the engine is shut down, and wherein the first shutter element is positioned upstream of a control valve of the crankcase ventilation system.

2. The assembly according to claim 1, wherein the internal combustion engine is a liquefied gas powered direct injection engine.

3. The assembly according to claim 1, wherein the first shutter element is positioned in a first part of the purge duct, wherein the first part is arranged between a valve cover provided over an upper part of the cylinder, and a control valve of the crankcase ventilation system.

4. The assembly according to claim 1, wherein the first shutter element is a one-way valve that is constructed and arranged for preventing residual gases and/or vapors out of a crankcase flow into the air intake system as long as the engine is shut down.

5. The assembly according to claim 1, wherein the one-way valve is constructed and arranged such that it has an opening pressure of typically at least 1 mbar (10 mm $H_2O$).

6. The assembly according to claim 1, wherein the outlet is constructed and arranged in the first part of the purge duct upstream of the first shutter element such that at least a part of the residual gases and/or vapors out of a crankcase are removable from the engine as long as it is shut down.

7. The assembly according to claim 1, wherein the outlet is connectable to a storage element that is constructed and arranged for storing and/or scrubbing the residual gases and/or vapors.

8. The assembly according to claim 1, wherein the shutter arrangement further comprises a second shutter element that is positioned in the purge duct downstream of the first shutter element, wherein the second shutter element is constructed and arranged for preventing residual gases and/or vapors out of a crankcase flow into the air intake system during the period of time that starts at shut down of the engine and ends after it has been re-started.

9. The assembly according to claim 8, wherein the second shutter element is positioned in a second part of the purge duct, wherein the second part is arranged between the control valve and an air intake duct of the air intake system.

10. The assembly according to claim 8, wherein the second shutter element is constructed and arranged such that it is switchable between at least a first and a second state, wherein the second shutter element is in the first state during the period of time that starts at shut down of the engine and ends after it has been re-started, and wherein the second shutter element is in the second state outside that period of time.

11. The assembly according to claim 10, wherein the second shutter element is constructed and arranged for disconnecting the purge duct from the air intake duct and allowing air out of an air cleaner unit to flow into the air intake duct via at least a part of the second part of the purge duct when it is in the first state.

12. The assembly according to claim 10, wherein the second shutter element is constructed and arranged for allowing gases and/or vapors out of a crankcase to flow into the air intake duct via at least a part of the second part of the purge duct when it is in the second state.

13. The assembly according to claim 8, wherein the second shutter element is a computer controlled 3/2 valve.

14. A crankcase ventilation system for use in an internal combustion engine with at least one cylinder having a piston and a combustion chamber, wherein the crankcase ventilation system comprises:

a shutter arrangement that is constructed and arranged for preventing residual gases and/or vapors out of a crankcase flow into an air intake system for the cylinder during a period of time that starts at shut down of the engine and ends after it has been re-started, and an outlet that is constructed and arranged for removing at least a part of the residual gases and/or vapors from the engine as long as it is shut down, wherein the shutter arrangement comprises a first shutter element that is positioned in a purge duct of the crankcase ventilation system, wherein the first shutter element is constructed and arranged for preventing residual gases and/or vapors out of a crankcase flow into an air intake system as long as the engine is shut down, wherein the first shutter element is positioned in a first part of the purge duct, wherein the first part is arranged between a valve cover provided over an upper part of the cylinder, and a control valve of the crankcase ventilation system.

15. An internal combustion engine comprising a crankcase ventilation system according to claim 14.

16. A vehicle comprising an internal combustion engine according to claim 15.

17. A method for providing an assembly in a crankcase ventilation system of an internal combustion engine with at least one cylinder having a piston and a combustion chamber, wherein the method comprises:

arranging at least one of: a first shutter element in a purge duct of the crankcase ventilation system, wherein the first shutter element is positioned between a valve cover provided over an upper part of the cylinder, and a control valve of the crankcase ventilation system and a second shutter element in the purge duct, wherein the second shutter element is positioned between the control valve and an air intake duct for the cylinder; and arranging an outlet in the purge duct, wherein the outlet is configured for removing at least a part of residual gases and/or vapors out of a crankcase from the engine as long as it is shut down.

* * * * *

UNITED STATES PATENT AND TRADEMARK OFFICE

CERTIFICATE OF CORRECTION

PATENT NO. : 9,010,285 B2
APPLICATION NO. : 14/050422
DATED : April 21, 2015
INVENTOR(S) : Servatius Alfons Maria Jaasma It is certified that error appears in the above-identified patent and that said Letters Patent is hereby corrected as shown below:

In the specification

In column 8 at line 2, Change “a long” to --as long--.

Signed and Sealed this
Twenty-ninth Day of December, 2015

Michelle K. Lee

Michelle K. Lee
*Director of the United States Patent and Trademark Office*